United States Patent [19]

Jenkins

[11] 4,266,601

[45] May 12, 1981

[54] HEAT EXCHANGER FOR CONTAMINATED WATER

[75] Inventor: Jack L. Jenkins, Hawthorne, Nev.

[73] Assignee: The United States of America as represented by the Secretary of the Navy, Washington, D.C.

[21] Appl. No.: 74,844

[22] Filed: Sep. 13, 1979

[51] Int. Cl.[3] ..... F28F 17/00; F22B 37/48

[52] U.S. Cl. ..... 165/94; 15/179; 15/201; 15/246.5; 165/95; 165/154; 165/164

[58] Field of Search ..... 165/94, 95, 154, 164; 15/56, 72, 179, 194, 201, 202, 246.5

[56] References Cited

U.S. PATENT DOCUMENTS

| | | | |
|---|---|---|---|
| 246,757 | 9/1881 | Greenway | 15/201 |
| 486,554 | 11/1892 | Blackmore | 165/94 |
| 1,082,922 | 12/1913 | Bemis | 15/201 |
| 2,066,480 | 1/1937 | McKerrall | 165/94 |
| 3,354,136 | 11/1967 | Crawford | 165/94 |
| 3,386,118 | 6/1968 | Morioku et al. | 15/201 |
| 3,406,741 | 10/1968 | Leach | 165/94 |
| 3,495,951 | 2/1970 | Tanaka et al. | 165/94 |
| 3,681,811 | 8/1972 | Amelung | 15/56 |
| 4,036,594 | 7/1977 | Ibing et al. | 165/94 |
| 4,185,352 | 1/1980 | Smith | 165/95 |

FOREIGN PATENT DOCUMENTS

| | | | |
|---|---|---|---|
| 981649 | 1/1965 | United Kingdom | 165/95 |

*Primary Examiner*—Daniel J. O'Connor

*Attorney, Agent, or Firm*—R. S. Sciascia; Charles D. B. Curry; George L. Craig

[57] ABSTRACT

A heat exchanger for cooling contaminated liquids causing precipitation of solid matter on cold walls. Waste water at high temperature containing contaminants in the form of sludge and in solution is pumped through the annular space between two concentric cylindrical tanks. Cooling water is circulated through the tanks on either side of the annular space while scraping devices rotate about the annular space preventing buildup of precipitate on the annular space walls.

7 Claims, 3 Drawing Figures

HEAT EXCHANGER FOR CONTAMINATED WATER

BACKGROUND OF THE INVENTION

1. Field of the Invention

The present invention relates to a heat exchanger. More particularly, it relates to a method and apparatus for cooling contaminated water. Most specifically, it relates to a method and apparatus for cooling explosive-contaminated water using ambient temperature water circulated in two concentric cylinders and employing a brushing device to continually clean the cooling surfaces exposed to the contaminated water.

2. Description of Prior Art

The art of heat exchangers is well known as are techniques for maintaining efficient heat transfer characteristics of such devices under sustained operational use. In special applications, however, unique design problems arise creating unique and novel solutions. Treatment of very hot contaminated water containing contaminates that must be precipitated out by cooling prior to further treatment, e.g., explosive contaminats, is such a special application.

Generally, the art of heat exchangers deals with complicated tubular arrays wherein the tubular arrays transport the material to be heated/cooled through an enclosed heating/cooling medium. The tubes are then periodically cleaned by one of two processes. First the entire apparatus is shut down and the tubes cleaned by brushes, solvents, air pressure or the like. This is not desirable in the treatment of explosive contaminated water because the shut-down of the apparatus usually results in immediate further coating of the cold walls of the heat exchanger by the explosive contaminates. A second approach of conventional tubular arrays is to periodically inject plugs of some sort into the tubular flow path and having the plugs scrape away fouling on the inside of the tubes. In treatment of contaminated water wherein the stage immediately following the precipitation process caused by the heat exchanger is a filtration process, e.g., explosive-contaminated water, the plugs would soon block the filtration process and cause system shut down to remove the plugs or replace the filtration stage—resulting in the problem effects of the first approach.

Heat exchanger design specifically related to treatment of contaminated water where the contaminates are to be precipated out within the heat exchanger have generally been large complex installations having a common approach. This approach is to circulate a coolant through a pipe having a number of fins, bristles, or the like along its outer surface and to then move the pipe through the contaminated water or cause the contaminated water to circulate about the stationary pipe. The contaminates precipitate upon the projecting fins, bristles, spikes or the like until a sufficient amount accumulates on the projections. The heat exchanger is then shut down and the pipe withdrawn. Steam or water under pressure at approximately 180–200° F. is injected onto the precipitate-coated projections causing melting and erosion of the precipitate. The waste water is then passed through a filter to remove pieces of precipitate. This conventional technique, called hot-water washout, has several shortcomings. First, the shut-down . . . start-up . . . shut-down cycle is slow and expensive to remove relatively small amounts of precipitate/cycle. Second, the shut-down of the exchanger causes immediate precipitate build-up on the inner-walls of the heat-exchanger, discussed supra, and necessitates including a sludge-pit beneath the heat exchanger that must be periodically scraped clean of the contaminates precipitated by shut-down. Third, the steam or hot water causes some of the contaminant to go back into solution thus negating some of the effect of both the heat-exchanger and the filter. Forth, adsorbtion beds usually receive water passing from the filter in conventional systems and the redissolved precipitate coming from the filter loads the adsorbtion bed with greater amounts of contaminate thus reducing the service life of the adsorbtion bed. Finally, many conventional systems, as a final stage, dump the remaining contaminated water into open pits allowing the water to leach and evaporate before covering the residue or allow the residue to dry and then burn it. Neither method is acceptable under present-day environmental standards.

SUMMARY OF THE INVENTION

The instant invention is briefly summarized as an improved heat exchanger for cooling contaminated liquids causing precipitation of solid matter on cold walls. Waste water at high temperature containing contaminants in the form of sludge and in solution is pumped through the annular space between two concentric cylindrical tanks. Cooling water is circulated through the tanks on either side of the annular space while scraping devices rotate in and about the annular space preventing buildup of precipitate on the annular space walls.

A primary object of invention is to build an improved heat exchanger permitting a high level of precipitation of contaminants out of initially hot waste water and preventing the buildup of precipitate on or within the heat exchanger.

Another object of invention is to continuously mechanically clean the cold walls of the heat exchanger and to induce turbulence in the contaminated water such that a constant heat transfer rate is maintained in the heat exchanger.

Another object of invention is to provide an improved heat exchanger whereby the cooling walls are continuously mechanically cleaned and turbulence is mechanically induced into the cooled waste water to prevent clogging of subsequent decontamination equipment downstream from the heat exchanger.

Yet another object of invention is to use spring biased brushes to continuously prevent the build-up of precipitated waste materials on the cold walls of an improved heat exchanger.

Still another object of invention is to use ambient temperature water from an external reservoir to provide the circulating cooling liquid rather than a cold refrigerant in the improved heat exchanger.

DESCRIPTION OF THE PREFERRED EMBODIMENT

While the present invention is described with particular reference to a heat exchanger used to decontaminate hot waste water containing explosive contaminates, it is apparent that the invention's novel characteristics will apply equally well to any situation in which contaminants are to be precipitated out of a relatively hot liquid in a highly efficient and economical manner.

Figure 1:
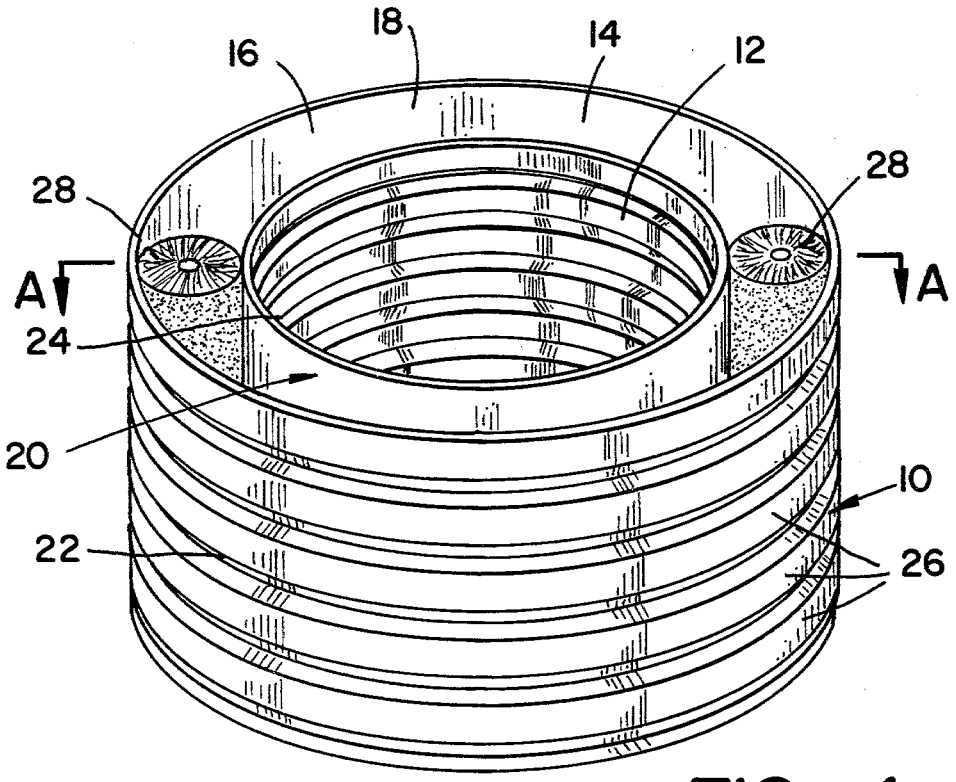
FIG. 1 is a perspective view of the basic embodiment of the improved heat exchanger.
Figure 2:
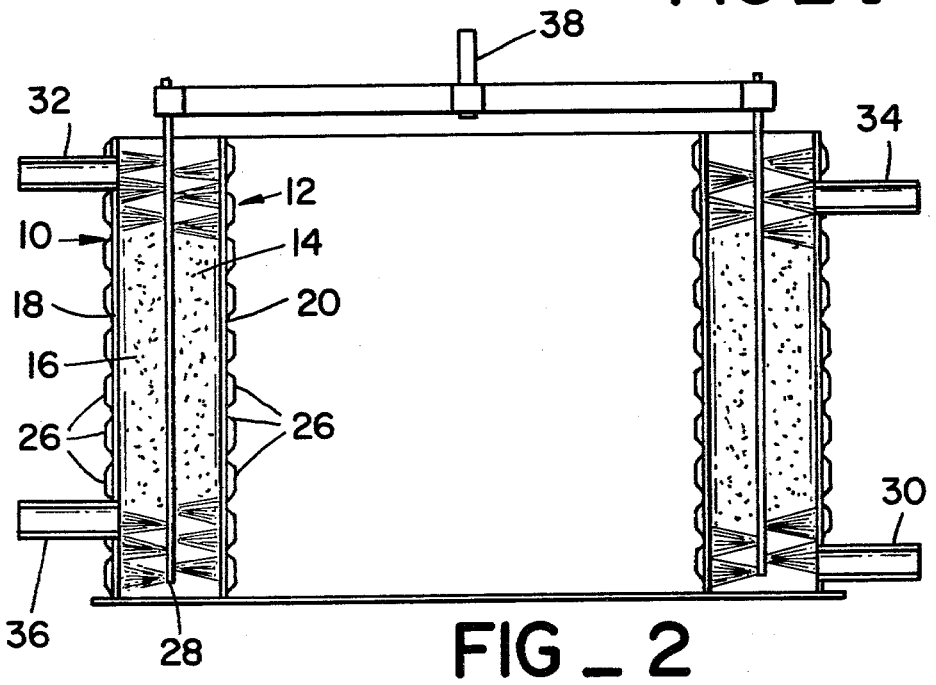
FIG. 2 is a section view across AA' of FIG. 1.
Figure 3:
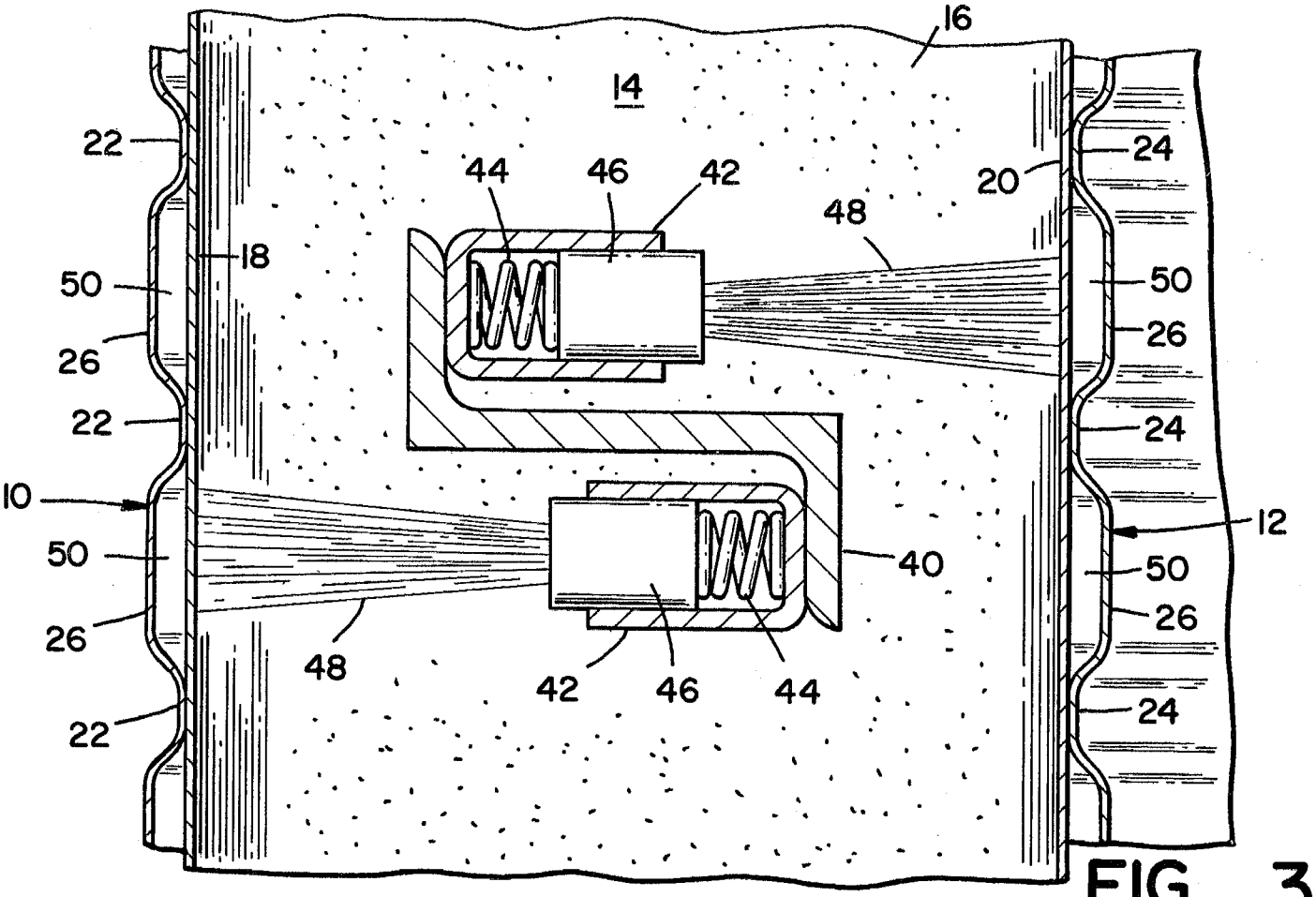
FIG. 3 is an expanded section view of one of the individual brushes comprising the brush assembly and a cross-section view of a cooling jacket.

FIG. 1 is a perspective view of the basic embodiment of the invention. A first large cylindrical vessel 10 encloses a smaller cylindrical vessel 12. The two cylinders 10, 12 are coaxial and have the same height but have different diameters such that an annular space 14 is left between them into which hot contaminated water 16 is circulated. The inner wall 18 of the first cylinder 10 is smooth as is the outer wall 20 of the inner cylinder 12. The outer wall 22 of the outer cylinder 10 and the inner wall 24 of the inner cylinder 12 have a number of channels 26 encircling their respective cylinders as shown through which ambient cooling water is circulated. Two large brushes 28 rotate in and about the annular space 14 such that contaminates precipitated upon the walls 18, 20 are continuously removed from the walls and kept in suspension thereby maintaining the efficiency of the heat transfer across the cylinder walls. FIG. 2 shows a cross-section view of the basic embodiment along the line AA' of FIG. 1. The hot contaminated water is pumped into the annulus 14 at input pipe 30 at approximately 200° F. and removed via output pipe 32 at approximately 85° F. for transport to a filter bed, not shown. The ambient cooling water is inputted via pipe 34 into the cooling jacket made up of the many conduits 26 and removed via pipe 36 for transport back to the coolant reservoir, not shown. The rotating mechanism 38 for the two large brushes 28 is mounted above the cylindrical vessels 10, 12. FIG. 3 shows the detail construction of one of the two large brushes 28. The central spine 40 of one of the large brushes 28 has attached to it a number of channels 42, each enclosing a spring 44 attached to a piston 46 which is in turn attached to a smaller brush 48 which is resiliently biased to maintain continuous pressure against one of the smooth walls inside the annulus. FIG. 3 also shows a cross-section of the wall construction of the heat exchanger. The inner wall 18 and the outer wall 20 are smooth surfaces as presented to the hot waste water 16 and the channels 26 in the outer wall 22 and inner wall 24 conduct the cooling medium 50.

Obviously the heat exchanger described herein could be constructed using four concentric cylinders such that three annular rings are formed—the inner and outer ring forming the cooling jackets to contain the circulating coolant and the central annulus to contain the hot waste water to be cooled. However, the preferred embodiment for construction of the cooling jackets is that construction of cylinders 10 and 12 shown in FIG. 3.

The instant invention provides several advantages over conventional heat exchangers. The continuous cleaning of the smooth cold-surface walls prevents buildup of precipitated contaminants on the cold walls and thus maintains a non-deteriorating heat transfer rate. The use of an ambient temperature cooling medium, e.g., pond water, rather than a refrigerant is much less expensive, requires much less complex equipment and reduces the tendency for the contaminants to plate the cold walls. The brushes impart a turbulence to the waste water increasing the removal of precipitates from the cold walls and, by increasing convective flow, further enhancing overall heat transfer. The individual brushes 28 obviously may be made to rotate about their longitudinal axis if further turbulence is required but in the preferred embodiment they do not rotate since efficiency is such as not to need the added turbulence. Finally, the instant invention is so efficient as not to require a sludge pit under the exchanger. Conventional heat exchangers relying on precipitating waste materials out of hot liquids generally operate such that a steady buildup of precipitates not kept in suspension within the cooling apparatus accrues at the bottom of the heat exchanger. Such systems require a sludge pit beneath the exchanger and must periodically be shut down and the sludge pit scraped and cleaned to maintain operation. No such buildup occurs in the instant invention on either the brushes or the bottom of the heat exchanger apparatus. The waste material is precipitated out by the cooling walls, kept in suspension by the rotating brushes and piped to the filter beds. Initial tests demonstrate that nearly 80% of the waste material in solution is precipitated out.

A few design parameters for the instant invention are given below by way of example although the invention is by no means limited solely to these parameters.

| | |
|---|---|
| Inner diameter (outer cylindrical tank) | 20 feet |
| Outer diameter (inner cylindrical tank) | 19 feet |
| Height (inner and outer cylindrical tanks) | 4 feet |
| Waste liquid input temperature | 200° F. |
| Waste liquid output temperature | 85° F. |
| Cooling medium temperature (ambient range) | 40°–70° F. |
| Flow rate, waste liquid | 200 gal/min |
| *Flow velocity (in channels) cooling liquid | 10–100 ft/sec |

*The flow velocity is variable and may be adjusted according to the ambient temperature used. The heat transfer coefficient is proportional to the flow velocity to the eight-tenths power.

What is claimed is:

1. A heat exchanger comprising:

(a) a large cylindrical tank open at the top to ambient pressure, said tank having a base and a first hollow region concentric about the longitudinal axis of said tank, a first annular structure concentric about said first hollow region, a second hollow region concentric about said first annular structure and a second annular structure concentric about said second hollow region, said second hollow region having an inner wall formed by the outer surface of said first annular structure and an outer wall formed by the inner surface of said second annular structure;

(b) means for introducing a contaminated liquid medium to be cooled into said second hollow region;

(c) means for removing said liquid medium from said second hollow region;

(d) means for injecting a cooling medium under selectively variable pressure into said first and said second annular structures such that a selectively variable cooling rate of said inner and said outer walls of said second hollow region is obtained;

(e) means for extracting said cooling medium from said first and said second annular structures;

(f) means for brushing continuously said inner and said outer walls of said second hollow region; and (g) means for filtering said cooled contaminated liquid medium.

2. A heat exchanger as recited in claim 1 wherein said first annular structure has a first central enclosed annular chamber for receiving said cooling medium.

3. A heat exchanger as recited in claim 1 wherein said second annular structure has a second central enclosed annular chamber for receiving said cooling medium.

4. A heat exchanger as recited in claim 1 wherein said first annular structure includes:

(a) a first inner cylinder having an inner and an outer surface; and (b) a first series of circumferential conduits arrayed on said inner surface of said first inner cylinder, said first series of conduits connected to said injecting means and said extracting means and transporting said cooling medium.

5. A heat exchanger as recited in claim 1 wherein said second annular structure includes:

(a) a second exterior cylinder enclosing said first inner cylinder and having an inner and an outer surface; and (b) a second series of circumferential conduits arrayed on said outer surface of said second cylinder, said second series of conduits connected to said injecting means and said extracting means and transporting said cooling medium.

6. A heat exchanger as recited in claim 1 wherein said brushing means includes:

(a) a plurality of large brushes, said large brushes having diameter approximately equal to the width of said second hollow region and length approximately equal to the axial length of said second hollow region; and (b) means for rotating said large brushes within said second hollow region and about the longitudinal axes of said brushes.

7. a brushing means as recited in claim 6 wherein each of said large brushes includes:

(a) a central spine extending the length of said large brush;

(b) a plurality of channels arrayed along and about said central spine, each of said channels having the form of a semi-closed cylinder having an interior base and an open end;

(c) a plurality of springs, each of said springs having one end associated with and attached to one of said interior bases of one of said channels;

(d) a plurality of pistons, each of said pistons associated with and attached to the other end of one of said springs within one of said channels; and (e) a plurality of small brushes, each of said small brushes having a base associated with and attached to one of said pistons and a top extending out of one of said channels such that said tops of said small brushes are continuously resiliently biased against said inner and outer walls of said second hollow region.

* * * * *